US007674155B2

(12) United States Patent
Gebhart et al.

(10) Patent No.: US 7,674,155 B2
(45) **Date of Patent: *Mar. 9, 2010**

(54) PROCESS AND APPARATUS FOR ARTIFICIALLY AGEING BLOCKS

(75) Inventors: Hans Gebhart, Memmingen (DE); Martin Rothdach, Holzguenz (DE); Thomas Riedle, Aitrach (DE); Hermann Sauter, Tannheim (DE)

(73) Assignee: Baustoffwerke Gebhart & Sohne GmbH & Co. KG, Aichstetten (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/166,740

(22) Filed: Jul. 2, 2008

(65) Prior Publication Data

US 2008/0263996 A1 Oct. 30, 2008

Related U.S. Application Data

(62) Division of application No. 10/818,438, filed on Apr. 5, 2004, now Pat. No. 7,404,755.

(30) Foreign Application Priority Data

Dec. 29, 2003 (DE) ..... 103 61 732

(51) Int. Cl.
*B24B 1/00* (2006.01)

(52) U.S. Cl. ..... 451/32; 451/35; 451/326; 125/40

(58) Field of Classification Search ..... 451/32, 451/35, 326, 330; 125/1, 40
See application file for complete search history.

(56) References Cited

U.S. PATENT DOCUMENTS

| | | | |
|---|---|---|---|
| 4,263,240 | A | 4/1981 | Postell, Jr. |
| 5,743,790 | A | 4/1998 | Trahan |
| 6,279,291 | B1 | 8/2001 | Geusens et al. |
| 6,749,793 | B1 | 6/2004 | Hagenah |
| 2004/0037912 | A1 | 2/2004 | Waltering |

FOREIGN PATENT DOCUMENTS

| | | |
|---|---|---|
| DE | 29 22 393 | 12/1979 |
| DE | 36 21 276 | 1/1988 |
| DE | 36 21 276 C2 | 7/1990 |
| DE | 198 45 174 | 4/2000 |
| DE | 103 07 447 | 9/2002 |
| EP | 0 860 258 B1 | 8/1998 |
| WO | 02/45928 | 6/2002 |

*Primary Examiner*—Eileen P. Morgan
(74) *Attorney, Agent, or Firm*—Davis & Bujold, P.L.L.C.

(57) ABSTRACT

A process for artificially ageing blocks, in particular concrete blocks, vitrified bricks and natural stones, provides that the blocks are applied to an underlying surface. Essentially freely movable distressing bodies are applied to the surface to be worked of the blocks. The blocks and the distressing bodies are brought into movement in relation to one another by a vibrating motion of the underlying surface in such a way that the distressing bodies act on the surface and the adjoining, exposed edges of the blocks.

17 Claims, 2 Drawing Sheets

PROCESS AND APPARATUS FOR ARTIFICIALLY AGEING BLOCKS

This application is a divisional patent application of U.S. application Ser. No. 10/818,438 filed Apr. 5, 2004 which claims priority from German Application Serial No. 103 61 732.9 filed Dec. 29, 2003.

FIELD OF THE INVENTION

The invention relates to a process for artificially ageing blocks, in particular concrete blocks, vitrified bricks and natural stones. The present invention also relates to an apparatus for artificially ageing blocks.

BACKGROUND OF THE INVENTION

Blocks, for example paving elements, facade elements, sand-lime blocks, concrete blocks, bricks or vitrified bricks, natural stones and the like, are often subjected to subsequent treatment, irrespective of the nature of their material, in order to lose their artificial appearance.

Particularly frequently, freshly produced, set concrete blocks, in particular concrete paving slabs, are subjected to such subsequent treatment, in the course of which the surfaces and/or the edges are distressed or broken, in order to adapt the appearance to that of natural stones. For this purpose, the concrete blocks are introduced in relatively large numbers into a rotating drum, where they are "rumbled", the surfaces and edges of the blocks striking against one another and the blocks treated in this way leaving the drum in an "aged" state. Such an apparatus is known from DE-A 29 22 393.

When concrete blocks are treated in a rotating drum, surfaces and edges which are not even visible, for example when the aged blocks are used in paving, are also worked. To this extent, energy and time are unnecessarily wasted. Furthermore, for shipping purposes it is necessary to arrange the concrete blocks which have been treated and have left the rotating drum in a regular arrangement on a pallet, which requires an inordinate amount of work and time.

The prior art discloses a process, which is an alternative to the rotating drum, in which the blocks to be aged are placed together with distressing bodies onto an inclined channel. This channel is made to vibrate, so that the blocks strike against one another and against the distressing bodies. As a result, the blocks are given an aged appearance, which corresponds approximately to the result of the rotating drum described above. On account of the inclination of the channel, the blocks to be worked and the distressing bodies travel from an upper end to a lower end of the channel. Once the blocks and the distressing bodies have left the channel at its lower end, the distressing bodies are separated from the blocks. The distressing bodies are fed back to the upper end of the channel, while the blocks are conveyed further to a sorting device.

The prior art discloses for the sorting of the blocks, sorting installations which appropriately align the blocks and arrange them in pallet form. Such sorting installations cause high procurement and operating costs and also have a corresponding space requirement.

DE 36 21 276 C2 discloses a process in which concrete blocks are applied as a single layer in regular arrangement to an underlying surface in the form of a panel. Subsequently, the exposed surface and the adjoining exposed edges, or essentially only the edges, of the concrete blocks are distressed in an irregular manner by means of a vibrating striking or distressing device.

This process makes it possible to dispense with a subsequent sorting device, since the layer of blocks as they are produced is not changed. Before being worked with the striking or distressing devices, the blocks are pushed together on the underlying surface in the form of a panel and aligned, so that the blocks lie close together and there are no longer any intermediate spaces between them. The distressing tools of the distressing device are arranged on a movable carriage, which takes them over the surfaces of the blocks, so that the free surfaces and the upper edges of the blocks are distressed in an irregular manner by the distressing tools.

A disadvantage of this process, however, is that the blocks aged in this way look as though they have been artificially worked and not naturally aged. An ideal edge rupture of the blocks, as produced by the rumbling of the blocks in a rotating drum, is not obtained by using the process of the congeneric document.

EP 0 860 258 B2 discloses an apparatus and a process in which the blocks are arranged in one or two layers, preferably in the layer in which they are produced, between two elements, preferably plates. In this arrangement, the lower plate, on which the concrete blocks rest, is in operative connection with a vibration device. The vibration device is used to bring the blocks into movement, so that they are moved back and forth between the plates. As this happens, the blocks strike against one another and against the upper and lower plates, whereby the edges are broken on the upper side and underside. Furthermore, the upper sides and undersides of the blocks are distressed by the respectively assigned plates. The vertical side edges of the concrete blocks and the side faces are broken or distressed by the respectively adjacent concrete blocks.

It has been found in tests that the edge rupture is much worse the larger the size of the block to be aged. This is a result of the fact that the distressing angle is all the more shallow the larger the size of the block lodged between the plates. The shallow distressing angle results in unfavorable rupture of the edges.

In a way analogous to the ageing process by means of the rotating drum, there is, in this case, the disadvantage that surfaces and edges of the blocks which are possibly not visible are worked, resulting in energy and time being unnecessarily wasted. In addition, the necessary working time, in particular in the case of set concrete blocks, is high and the edge rupture is not ideal.

The present invention is, therefore, based on the object of providing a process and an apparatus for artificially ageing blocks, in particular concrete blocks, vitrified bricks and natural stones, whereby energy- and time-saving ageing is possible with an advantageous edge rupture.

SUMMARY OF THE INVENTION

In a surprising way, the inventor has discovered that rapid and effective ageing of the upper side of the blocks and the exposed edges adjoining it is obtained by the solution according to the invention. The vibrating motion of the underlying surface thereby causes the distressing bodies, and to a lesser extent also the blocks, to be set in motion.

The intensity of the motion of the blocks and of the distressing bodies is dependent on the vibration, the number of blocks and distressing bodies, and their weight. In a simple way, this allows the effect to be achieved that the distressing bodies are repelled upwards from the surface of the blocks on which they rest. Due to the force of gravity, the distressing bodies subsequently fall back again onto the surface of the blocks and collide with them or have an "ageing" effect on them. The blocks are distressed in an irregular manner by the random upward propulsion of the distressing bodies and, likewise, random falling back of the distressing bodies. This produces a visual appearance corresponding to that of a naturally aged block.

As the inventor has discovered, the action of the distressing bodies on the edges of the blocks is particularly effective, so that the latter are broken in the desired way, and the aged visual appearance is obtained as a result, within an extremely short time.

It may be advantageous in this case if the blocks are provided with a certain free space, which allows lateral movement of the blocks, so that the edges of the blocks can assume a distance from one another. The reason for this is not that this distance can cause the edges of the blocks to strike against one another (due to the vibration), but that the distressing bodies can strike particularly effectively in the intermediate space or gap between two edges and consequently break the edges in a visually advantageous way. In principle, breaking or working the edges is also possible without such a distance.

It is of advantage if the free space which is provided for the blocks to move sideways is smaller than the minimum diameter of the distressing bodies. This prevents the distressing bodies from being able to get into the gap between two edges of two adjacent blocks. For example, if the distressing bodies have a minimum diameter of 5 cm, it may be provided that the overall free space provided for the blocks to move sideways is 4 cm.

The solution, according to the invention, is not restricted to the simultaneous ageing of a specific number of blocks or a layer of blocks. The expression "apparatus or process for artificially ageing blocks" can, likewise, be understood as meaning that only a single block is aged according to the process or is fed to the apparatus.

The apparatus may be designed, for example, in the form of a channel through which the blocks travel individually or in one or more rows. In this case, the distressing bodies are applied to the surface of the blocks at least in one region of the channel. The channel may, in this case, be in connection with a vibration device, for example with unbalanced mass vibration generators, which set the channel in a vibrating motion. The vibrating motion is thereby transferred via the blocks to the distressing bodies, which are consequently repelled from the surface of the blocks and fall back again onto them with a distressing action. The channel may preferably be designed at the sides in such a way that a lateral limitation is provided for the blocks and for the distressing bodies, so that both the blocks and the distressing bodies are restrained and prevented from leaving the channel.

The blocks may be placed onto the channel and removed again from it in any way desired. It may also be envisaged in this case that the channel is provided with a transporting belt.

It is of advantage if the blocks are aged in the layer in which they are produced. The blocks may, in this case, be applied to the underlying surface, preferably in the form of a panel, as a single layer in the layer in which they are produced. Many possibilities are available for this purpose from the general state of the art. After that, the distressing bodies are placed onto the surface of the blocks, the underlying surface subsequently being made to vibrate, or made to vibrate already before the distressing bodies are placed on. The ageing of an entire layer of blocks produced can consequently be carried out in a time- and energy-saving manner. The result thereby corresponds at least to the result of blocks aged in a rotating drum.

Subsequent sorting of the blocks is not necessary when using the process according to the invention.

In an advantageous embodiment, it may be envisaged that the underlying surface is provided with a surrounding border, by which the applied blocks are limited in their lateral movement. It is advantageous in this case if the surrounding border surrounds the blocks with play, so that the blocks can assume a distance from one another which permits the distressing bodies to act between two adjacent edges of the blocks and/or of one block and the surrounding border. It is particularly advantageous in this case if the surrounding border rises up above the surface of the blocks in the vertical direction, so that a lateral limitation is formed for the distressing bodies. The lateral limitation thereby restricts the movement of the distressing bodies essentially to the surface of the blocks.

After working, the distressing bodies can be removed again from the surface of the blocks in a simple way. Various technical configurations are possible for this purpose.

It is of advantage if the distressing bodies are formed from hard metal, metal or steel and, once the surface and/or the edges of the blocks have been worked, the distressing bodies are lifted off the surface magnetically. For this purpose, for example, a magnet may be arranged above the surface of the blocks. The distance of the magnet from the surface of the blocks may preferably be chosen such that the distressing bodies do not touch the magnet during the working of the surface of the blocks. The magnet may preferably be magnetized by applying a corresponding current. It may also be provided in this case that, for lifting the distressing bodies off the surface of the blocks, the magnet is brought up to the distressing bodies by means of a guiding device.

A depositing and removing device, which has a stripping element, which can be guided over the surface of the blocks to remove the distressing bodies, may also be provided as an alternative or in addition to the magnet. For this purpose, for example, two opposite sides of the surrounding border may be lowered or swung away, in order that the stripping element can be appropriately introduced and the distressing bodies pushed out.

The solution, according to the invention, permits working of the surface or the edges which, in the later, laid state of the blocks, form the visible side or enclose the latter. Consequently, no energy and time is wasted on working edges or surfaces which are not at all visible when the blocks are later used.

In an advantageous way, it is also possible for the ageing process to be carried out on concrete blocks which are relatively freshly produced. Such freshly produced, and consequently not yet adequately hardened, concrete blocks generally cannot be worked by means of other processes or apparatuses, since, for example in the case of ageing in a rotating drum, the risk of the entire block breaking is too high or a correspondingly high amount of wastage must be accepted, or high additional costs are required for rapid setting of the blocks.

The apparatus, according to the invention, makes it possible in an advantageous way for the layer in which the blocks are produced to be maintained, whereby it is possible to dispense with a time-consuming and costly sorting installation.

The underlying surface or the surrounding border of the underlying surface may be adapted to the various dimensions and forms which the layers in which blocks are produced have. For example, the underlying surface or the surrounding border of the underlying surface may have a circular form, if for example concrete paving slabs which are to represent circular paving are produced.

BRIEF DESCRIPTION OF THE DRAWINGS

The invention will now be described, by way of example, with reference to the accompanying drawings in which.

DETAILED DESCRIPTION OF THE INVENTION

According to the invention, any desired blocks, for example paving elements, facade elements, sand-lime blocks, concrete blocks, bricks or vitrified bricks or natural stones, can be aged, irrespective of the nature of their material. The ageing of blocks 1 which are formed as concrete blocks is presented below on the basis of the exemplary embodiments. However, it goes without saying that the invention is not restricted to this.

The production of concrete blocks 1, in particular of concrete paving slabs, is sufficiently known, for which reason it is not discussed in any more detail here. The concrete blocks 1 generally leave the production installation in a layer in which they are produced, i.e., in an arrangement in which a multiplicity of concrete blocks 1 are arranged next to one another as a single layer. Such a production installation is represented by way of example in FIGS. 1 to 5.

Figure 1:
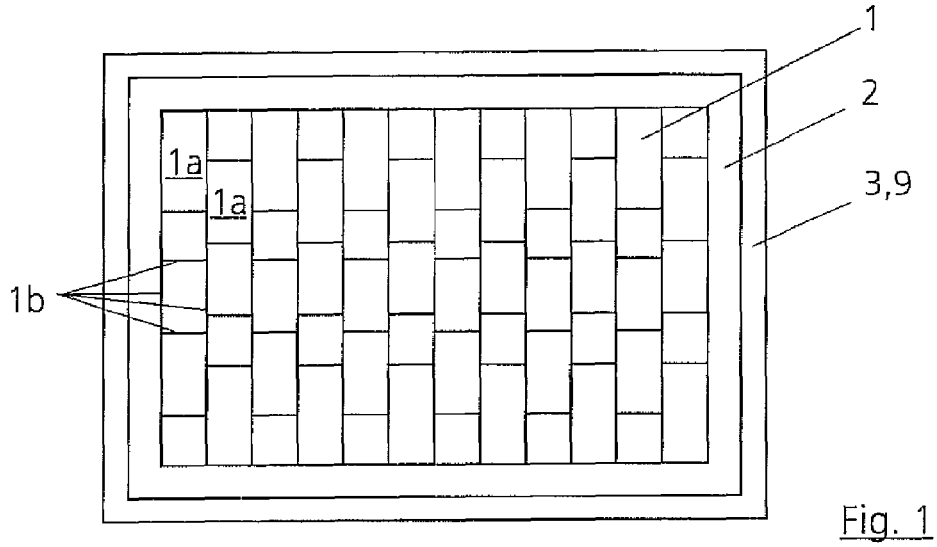
FIG. 1 shows a plan view of a layer of blocks as produced, which have been applied to an underlying surface.

As can be seen from FIG. 1, the concrete blocks 1 are applied as a single layer in regular arrangement to an underlying surface 2 in the form of a panel. The concrete blocks 1 are, in this case, arranged in such a way that an edge 1*b* respectively to be worked, or the surface 1*a* to be worked (=generally the side that will be visible later) of the block 1 lies at the top.

Figure 3:
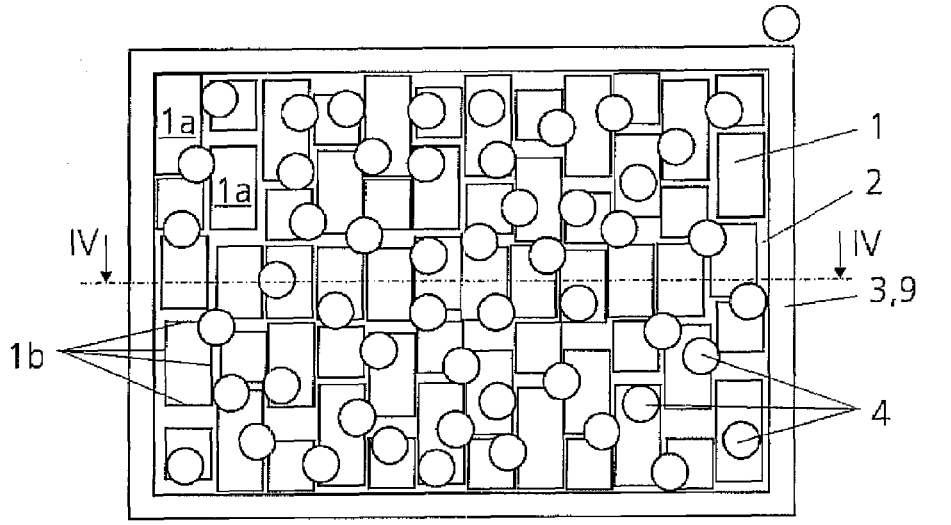
FIG. 3 shows a view of the arrangement represented in FIG. 2 in operation, the blocks having assumed a distance from one another on account of the vibration of the underlying surface.

As can be seen from FIG. 1, the underlying surface 2 has a surrounding border 3, which surrounds the blocks 1. The surface area of the underlying surface 2 enclosed by the surrounding border 3 is, in this case, greater than the surface area which the blocks 1 take up. Consequently—as a result of the vibrating motion of the underlying support 2—the blocks 1 have the possibility of assuming a distance from one another. This is represented in FIG. 3.

Figure 2:
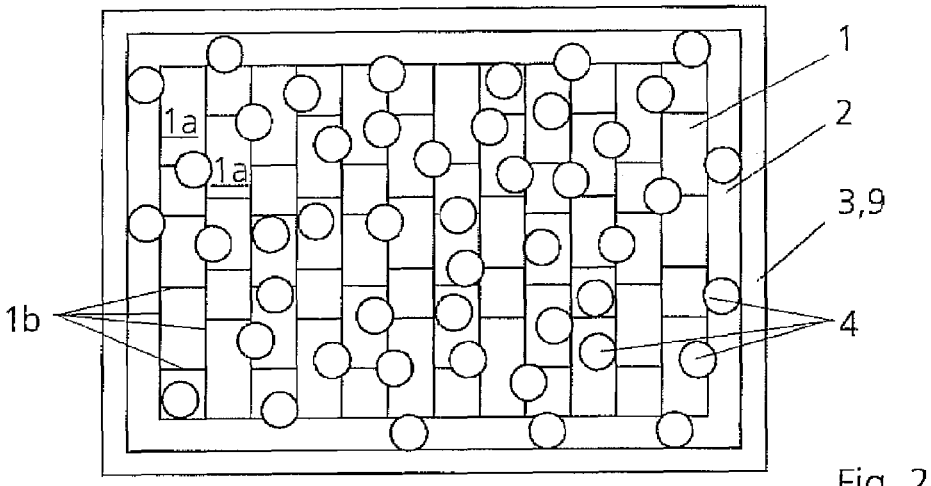
FIG. 2 shows a plan view of a layer of blocks as produced, which have been applied to an underlying surface, distressing bodies having been placed onto the surface of the blocks.

FIG. 2 shows a plurality of distressing bodies 4, which have been applied to or placed onto the surface 1*a* of the blocks 1. The distressing bodies 4 are freely movable with respect to the surface 1*a*. The distressing bodies 4 are, likewise, freely movable with respect to one another. The distressing bodies 4 may be produced from any desired material. In the exemplary embodiment, it is provided that the distressing bodies are formed from hard metal, metal or steel. The form of the distressing bodies 4 may, likewise, be chosen as desired, it having been found to be advantageous to form the distressing bodies 4 in a spherical, annular, polygonal or cylindrical manner. In the exemplary embodiment represented, the distressing bodies 4 are formed in a spherical manner.

Figure 4:
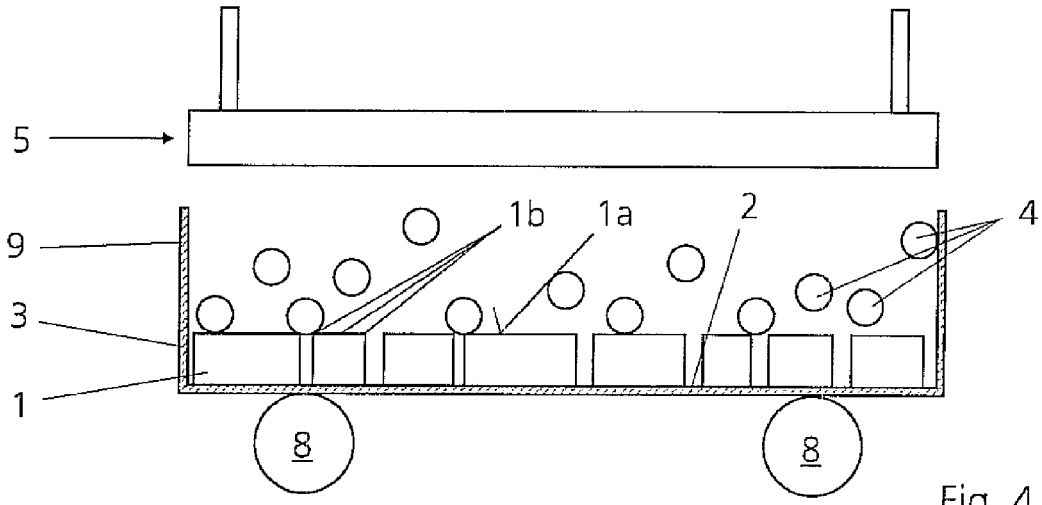
FIG. 4 shows a section along the line IV-IV of FIG. 3 with a representation of a magnet.

A depositing and removing device 5 is provided in the exemplary embodiment in order to deposit the distressing bodies 4 onto the surface 1*a* of the blocks 1 and remove them again from the latter. Various configurations are conceivable for this. In FIG. 4, a configuration of the depositing and removing device 5 as a magnet is provided. By appropriate magnetizing or demagnetizing of the magnet 5, the distressing bodies 4 are either attracted by the magnet 5 or fall from it in the direction of the surface 1*a* of the blocks 1.

Figure 5:
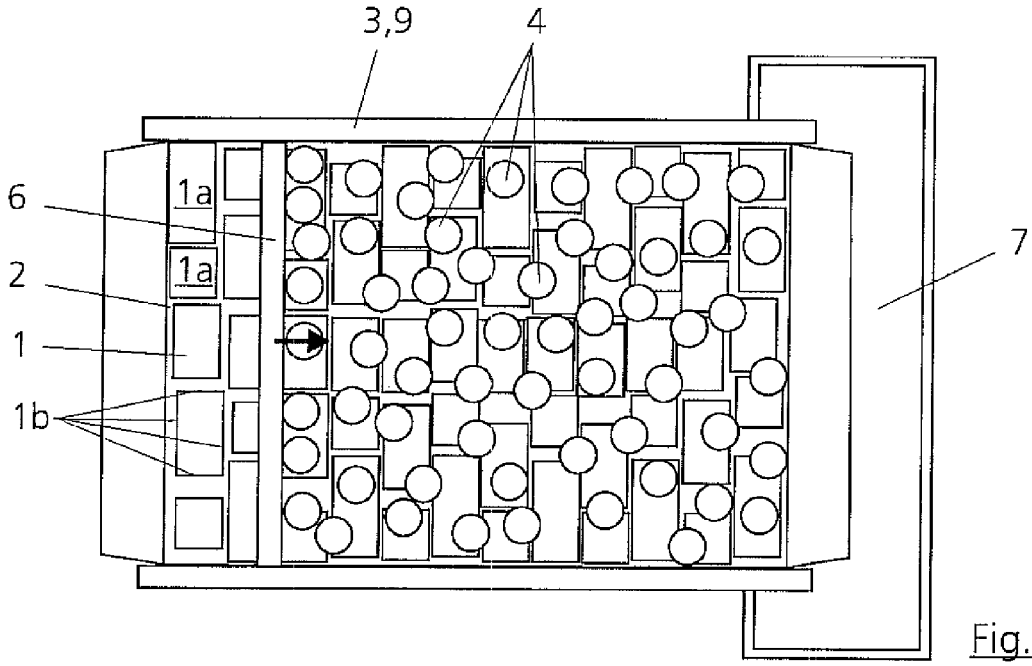
FIG. 5 shows a plan view of a layer of blocks as produced, after completion of the ageing process, with a stripping element for removing the distressing bodies from the surface of the blocks.

FIG. 5 shows an alternative configuration of the depositing and removing device 5 with a stripping element 6, which, after completion of the ageing process, pushes the distressing bodies 4 off the surface 1*a* of the blocks 1 and discharges them into a collecting container 7, for example by a linear movement. From this collecting container 7, the distressing bodies 4 can be transported further in a simple way, so that the distressing bodies 4 can be applied to a layer of blocks 1 newly applied to the underlying surface 2.

Once the distressing bodies 4 are resting on the surface 1*a* of the blocks 1, as shown in FIG. 2, the vibration process, or the actual ageing process, begins. In an alternative embodiment, it may also be provided in this case that the vibration process is already in progress while the distressing bodies 4 are applied. FIG. 3 shows a possible representation or arrangement of the blocks 1 during the ageing process, i.e., during the vibration of the underlying surface 2. To produce the vibration, a vibration device 8, such as that represented for example in FIG. 4; may be used. The vibration device 8 may have, for example, unbalanced mass vibration generators. The blocks 1 and the distressing bodies 4 are set in motion in relation to one another by the vibration device 8 in such a way that the distressing bodies 4 act on the surface 1*a* and the exposed edges 1*b* of the blocks 1. The vibrating motion of the underlying surface 2 causes the distressing bodies 4 to be repelled from the surface 1*a* of the blocks 1, in order subsequently to fall back again onto the surface 1*a* or the edges 1*b*. The lateral or horizontal movement of the distressing bodies 4 is, in this case, essentially restricted to the surface 1*a* of the blocks 1. Provided for this purpose are lateral limitations 9, which restrain the distressing bodies 4 in such a way that the lateral or horizontal movement of the distressing bodies 4 is essentially restricted to the surface 1*a* of the blocks 1.

FIG. 4 shows the lateral limitations 9 for the distressing bodies 4 in section.

By analogy with the limitation of the lateral or horizontal movement of the distressing bodies 4, the surrounding border 3 limits the lateral or horizontal movement of the blocks 1 applied to the underlying surface 2. It is provided in this case that the blocks 1 can assume a distance from one another which permits the distressing bodies 4 to act on two adjacent edges 1*b* of two blocks 1 and/or of one block 1 and the surrounding border 3, without the distressing bodies 4 being able to get completely into the intermediate spaces produced.

The surrounding border 3 may, in this case, be formed in such a way that two blocks adjacent to each other or a block 1 and the surrounding border 3 can assume at most a distance from one another which is less than the minimum diameter of the distressing bodies 4 placed onto the surface 1*a*.

As can be seen for example from FIG. 4, it is provided in the exemplary embodiment that the lateral limitations 9 are formed by a vertical extension of the surrounding border 3, rising up above the surface 1*a* of the blocks 1. The underlying surface 2 is consequently formed in the manner of a dish or pot.

The ageing process represented in FIG. 3 and FIG. 4, i.e., the working time during which the distressing bodies 4 act on the surface 1*a* and/or the edges 1*b* of the blocks 1, may be, for example, 5 to 50 seconds, preferably 15 to 30 seconds. The vibration of the underlying surface 2 is preferably chosen by means of the vibration device 8 such that the distressing bodies 4 are moved with a high amplitude.

In the embodiment represented in FIG. 4, in which it is provided that, after the working of the surface 1*a* and/or the edges 1*b* of the blocks 1, the distressing bodies 4 are magnetically lifted off the surface, a movable guidance of the magnet 5 may be provided, so that the distressing bodies 4 can be attracted in a particularly simple way. As can be seen from FIG. 4, the magnet 5 is arranged above the blocks 1 which have been applied to the underlying surface 2. As an alternative to a movable type of design of the magnet 5, it may also be provided that the magnetic force of the magnet 5 is chosen to be strong enough that the distressing bodies 4 can be lifted off the surface 1*a* and attracted to the magnet 5 even without any movement of the magnet 5. It is provided in this case that, for depositing the blocks 1, the magnetic force of the magnet 5 can be reduced in such a way that the distressing bodies 4 can fall back onto the surface 1*a* of the blocks 1 on account of their own weight or the force of gravity.

In the exemplary embodiment, it is provided that the number of distressing bodies 4 is chosen such that 30 to 90%, preferably 70%, of the surface 1*a* of the blocks 1 is covered. In an embodiment not represented, it may also be provided that the underlying surface 2 is inclined. In this case, it may also be provided that the inclination of the underlying surface 2 is changed continuously, so that the distressing bodies 4 or the blocks 1 are additionally set in motion.

An inclination of the underlying surface 2 may also be suitable for the removal of the distressing bodies 4, in particular if they are formed in a spherical manner. An inclination of the underlying surface 2 may, in this case, support a configuration of the depositing and removing device 5 as shown in FIG. 5, if the inclination of the underlying surface 2 slopes down in the direction of the collecting container 7. In order to be able to remove the distressing bodies 4 as shown in FIG. 5 in an advantageous way from the surface 1*a* of the blocks 1, it may be provided that at least the lateral limitation 9 facing the discharge region, i.e., the collecting container 7, or the corresponding extension of the surrounding border 3 can be removed or swung up. In order to be able to feed in the stripping element 6 as simply as possible, it may in this case also be provided that the opposite lateral limitation 9 or the corresponding vertical extension of the surrounding border 3 can be removed or swung up.

If appropriate, the underlying surface 2 may be provided with a transporting belt for the feeding in and/or carrying away of the blocks 1.

Figure 6:
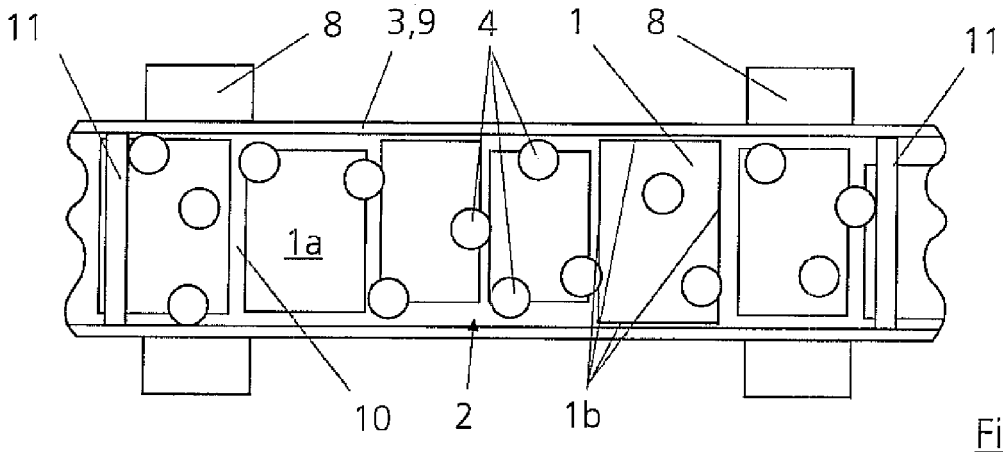
FIG. 6 shows an alternative representation of an underlying surface with an arrangement of blocks in the form of rows, distressing bodies having been applied to the surface of the blocks.

FIG. 6 shows a configuration of the underlying support 2 in the form of a channel. In this case, the use of a transporting belt 10 on which the blocks 1 are placed is envisaged. The blocks 1, in this case, pass through a region provided with distressing bodies 4. The underlying surface 2 is continuously made to vibrate by the vibration device 8, so that the distressing bodies 4 are continuously repelled upwards from the surface 1*a* of the blocks 1, in order subsequently to fall down again onto the surface 1*a* or the edge 1*b*. Suitable choice of the distance between the blocks 1 passed through and an adapted speed of the transporting belt 10 allow in a simple way the effect to be achieved that new blocks 1 are continuously fed in and met by the distressing bodies 4 set in motion. Consequently, interruption of the ageing process or a special depositing and removing device 5 is not necessary for the distressing bodies 4.

The underlying surface 2 may preferably be inclined in such a way that the underlying surface 2 rises slightly in the running-through direction and consequently counteracts an impulse which is imparted to the distressing bodies 4 by the movement of the blocks 1.

The region in which the distressing bodies 4 are arranged may be restricted for example by a dividing wall 11 at the beginning and the end of this region.

The dividing wall 11 is, in this case, preferably arranged in such a way that the blocks 1 can be transported through underneath it, but the distance between the dividing wall 11 and the surface 1*a* of the blocks 1 is not large enough to allow distressing bodies 4 also to be transported through underneath the dividing wall 11 in addition to the blocks 1. In addition, the dividing wall 11 preferably extends in the vertical direction in such a way that the distressing bodies 4 cannot be pushed over the dividing wall 11. The dividing wall 11 may, in this case, finish at its upper side flush with the lateral limitations 9 or the vertical extension of the surrounding border 3.

According to FIG. 6, it is provided that the distance between the individual blocks 1 and the surrounding border 3 is chosen such that the distressing bodies 4 can work the edges 1*b* well, but there is no chance of the distressing bodies 4 being able to get completely into the intermediate space formed by the distance.

In an embodiment that is an alternative to FIG. 6, it may also be provided that a number of rows of blocks 1 are arranged parallel to one another and pass analogously through the region provided with the distressing bodies 4.

In principle, an entire layer of blocks 1 as produced can also be worked, as shown in FIG. 6. In this case, preferably entire layers of blocks as produced are transported in series with one another—in a way analogous to the individual blocks 1—through a region provided with distressing bodies 4.

For ageing by means of the solution, according to the invention, slight vibration with a low frequency is already sufficient, since, as tests have shown, the blocks 1 can be worked quickly and effectively with the distressing bodies 4.

In addition, it is possible for the blocks 1 to be worked while they are in a relatively soft state (i.e., after a short drying time), since breaking of the blocks 1 is not to be feared. The working of relatively soft concrete blocks 1 means that the apparatus according to the invention undergoes only little wear. In addition, short working cycles are possible. A further advantage is that breaking of the blocks 1 is not to be expected, since the proportion of cement contained in the concrete blocks 1 can be reduced.

The apparatus according to the invention and the process according to the invention are suitable for ageing any desired blocks and are not restricted to concrete blocks 1 or a specific intended purpose. If appropriate, the blocks 1 may be placed into the apparatus according to the invention, a number of times, aligned in different ways so that a number of edges 1*b* or surfaces 1*a* are aged.

In the exemplary embodiment, it is provided that the distressing bodies 4 are completely freely movable. However, it may also be provided, according to the invention, that the distressing bodies 4 are essentially freely movable, i.e., for example the distressing bodies 4 could be connected to one another, so that a kind of network of distressing bodies 4 can be applied to the surface 1*a* of the blocks 1. The connection between the distressing bodies 4 could in this case take such a form that it permits a certain movement of the distressing bodies 4 within the network in relation to the other distressing bodies 4. Consequently, random impact of the distressing bodies 4 on the surface 1*a* within a specific free space continues to be ensured. Furthermore, it could be provided that the distressing bodies 4 are respectively suspended from flexible wires, cables, chains or the like, so that the distressing bodies 4 can be lowered onto the surface 1*a*. It may be provided in this case that the movement of the distressing bodies 4 is restricted only slightly by the wires or cables from which they are suspended. It may also be provided in this case that the wires permit a movement of the distressing bodies 4 within a specific radius, so that random impact on the surface 1*a* of the blocks 1 continues to be ensured. For removing the distressing bodies 4, the depositing and removing device 5 may be used for example. The distressing bodies 4 may be fastened to the latter by means of the wires or cables. By raising the depositing and removing device 5, or winding up the wires, the distressing bodies 4 may be raised—in a way similar to pins on a bowling alley—and in this way removed from the surface 1*a*.

In principle, various types of design which permit essentially freely movable arrangement of the distressing bodies 4, in particular with respect to the surface 1*a* or the edges 1*b* of the blocks 1, are conceivable.

In a particularly advantageous way, the solution according to the invention is also suitable for ageing split or cleft blocks, which generally have a surface which is uneven or provided with elevations and depressions. On account of the uneven surface, ageing of these blocks is not possible by the processes from the prior art. However, freely movable distressing bodies 4, according to the invention, are also suitable in the case of these blocks for ageing the edges and the surface.

What is claimed is:

1. A process for artificially ageing blocks (1) including at least one of concrete blocks, vitrified blocks and natural stone blocks, the process comprising the steps of:

placing the blocks to be worked (1) adjacent one another onto an underlying surface (2), applying substantially freely movable distressing bodies (4) to an upper surface (1*a*) of the blocks (1) to be worked, vibrating the underlying surface (2) thereby causing relative motion between the blocks to be worked (1) and the distressing bodies (4) such that at least one of vertical movement and horizontal movement of the distressing bodies (4), induced by the vibrating motion of the underlying surface (2) to the distressing bodies (4), via the blocks to be worked (1), on the upper surface (1*a*) and adjacent edges (1*b*) of the blocks to be worked (1) artificially ages the blocks (1), and transmitting a vertical component of the vibrating motion of the underlying surface (2), through the blocks to be worked (1), so as to cause the upper surfaces (1*a*) of the blocks to be worked (1) to propel the distressing bodies (4) upward, from the upper surface (1*a*) of the blocks to be worked (1) and thereafter fall back onto the upper surface (1*a*) of the blocks to be worked (1) and act on the upper surface (1*a*) and adjacent edges (1*b*) of the blocks to be worked (1).

2. The process according to claim 1, further comprising the step of restricting at least one of the vertical and the horizontal movement of the distressing bodies (4) substantially to the upper surface (1*a*) of the blocks (1).

3. The process according to claim 1, further comprising the step of limiting one of lateral movement and horizontal movement of the blocks to be worked (1) applied to the underlying surface (2).

4. The process according to claim 3, further comprising the step of spacing the blocks (1) horizontally apart from one another by a distance less than a maximum diameter of the distressing bodies so as to permit the distressing bodies (4) to fall into a space between adjacent blocks (1) and act on at least one of two adjacent edges (1*b*) of two blocks (1) and an edge (1*b*) of one block (1) and a surrounding border (3) without the distressing bodies (4) entirely entering the space between the adjacent blocks.

5. The process according to claim 1, further comprising the step of forming the distressing bodies (4) from at least one of a hard metal, a metal and a steel.

6. The process according to claim 1, further comprising the step of, after the working of the at least one of the upper surface (1*a*) and the adjacent edges (1*b*) of the blocks to be worked (1), removing the distressing bodies (4) from the upper surface (1*a*) of the aged blocks (1).

7. The process according to claims 1, further comprising the step of utilizing an amount of the distressing bodies (4) such that between 30 to 90% of the upper surface (1*a*) of the blocks to be worked (1) is covered when working the upper surface and the adjacent edges of the blocks to be worked (1).

8. The process according to claim 1, further comprising the step of permitting the distressing bodies (4) to act on at least one of the upper surface (1*a*) and the adjacent edges (1*b*) of the blocks (1) for a period of from 5 to 50 seconds.

9. A process for artificially ageing blocks (1) including at least one of concrete blocks, vitrified blocks and natural stone blocks, the process comprising the steps of:

placing the blocks to be worked (1) adjacent one another onto an underlying surface (2);

applying substantially freely movable distressing bodies (4) to an upper surface (1*a*) of the blocks (1) to be worked;

vibrating the underlying surface (2) thereby causing relative motion between the blocks to be worked (1) and the distressing bodies (4) such that at least one of vertical movement and horizontal movement of the distressing bodies (4), induced by the vibrating motion of the underlying surface (2) to the distressing bodies (4), via the blocks to be worked (1), on the upper surface (1*a*) and adjacent edges (1*b*) of the blocks to be worked (1) artificially ages the blocks (1); and transmitting the vertical component of the vibrating motion of the underlying surface (2), through the blocks to be worked (1), so as to cause the upper surface (1*a*) of the blocks to be worked (1) to propel the distressing bodies (4) upward away from the surface (1*a*) of the blocks to be worked (1) with a magnitude sufficient to distress at least one of the upper surface (1*a*) and the adjacent edges (1*b*) of the blocks to be worked (1) when the distressing bodies (4) fall back onto the upper surface (1*a*) of the blocks to be worked (1) due to gravity.

10. A process for artificially ageing at least one of concrete blocks, vitrified blocks and natural stone blocks, the process comprising the steps of:

applying the blocks (1) to an underlying surface (2);

applying substantially freely movable distressing bodies (4), formed of at least one of a hard metal, a metal and a steel, to an upper surface (1*a*) of the blocks to be worked (1);

vibrating the underlying surface (2) thereby causing relative motion between the blocks to be worked (1) and the distressing bodies (4) such that at least one of vertical movement and horizontal movement of the distressing bodies (4), induced by the vibrating motion of the underlying surface (2) to the distressing bodies (4), via the blocks to be worked (1), on the upper surface (1*a*) and adjacent edges (1*b*) of the blocks to be worked (1) artificially ages the blocks (1);

transmitting a vertical component of the vibrating motion of the underlying surface (2), through the blocks to be worked (1), so as to cause the underlying (1*a*) of the blocks to be worked (1) to propel the distressing bodies (4) upward, from the upper surface (la) of the blocks to be worked (1) and thereafter fall back onto the upper surface (1*a*) of the blocks to be worked (1) and act on the upper surface (1*a*) and adjacent edges (1*b*) of the blocks to be worked (1); and after the working of at least one of the upper surface (1*a*) and the adjacent edges (1*b*) of the blocks to be worked (1), magnetically removing the distressing bodies (4) from the upper surface (1*a*) of the aged blocks (1).

11. An apparatus for artificially ageing at least one of concrete blocks, vitrified bricks and natural stone blocks, the apparatus comprising:

an underlying surface (2) onto which the blocks (1) can be placed in such a way that an upper surface (1*a*) of the blocks to be worked (1) and adjacent edges (1*b*) of the upper surface of the blocks to be worked (1) are exposed, a plurality of freely movable distressing bodies (4) for applying to the upper surface (1*a*) and adjacent edges (1*b*) of the blocks to be worked (I), and a vibration device (8) for causing vibrating motion of the underlying surface (2) to cause relative motion, comprising at least one of vertical movement and horizontal movement, between the blocks to be worked (1) and the distressing bodies (4) by transmission of the vibrating motion of the underlying surface (2), via the blocks to be worked (1), to the distressing bodies (2) such that the distressing bodies (4) move at least one of horizontally and vertically, relative to the blocks to be worked (1), and act on the upper surface (1*a*) and the adjacent edges (1*b*) of the blocks to be worked (1), and the vibration device (8) generates a vertical component which propels the distressing bodies (4) sufficiently vertically upward, away from the surface (1*a*) of the blocks to be worked (1), to distress at least one of the upper surface (1*a*) and the adjacent edges (1*b*) of the blocks to be worked (1) when the distressing bodies (4) fall back onto the upper surface (1*a*) of the blocks (1).

12. The apparatus according to claim 11, wherein lateral boundaries walls (9) are provided for restricting the horizontal movement of the distressing bodies (4) essentially to the upper surfaces (1*a*) of the blocks to be worked (1).

13. The apparatus according to claim 11, wherein the underlying surface (2) is provided with a surrounding border (3) which restricts horizontal movement of the blocks to be worked (1).

14. The apparatus according to claim 12, wherein the lateral boundaries (9) for the distressing bodies (4) are formed by a vertical extension of a surrounding border which extends upward from the underlying surface (2) to a position above the upper surface (1*a*) of the blocks to be worked (1).

15. The apparatus according to claim 13, wherein the surrounding border (3) restricts movement of the blocks to be worked (1), on the underlying surface (2), so that spacing between adjacent blocks to be worked (1) is less than a minimum diameter of the distressing bodies (4).

16. The apparatus according to claim 11, wherein the distressing bodies (4) are formed from at least one of a hard metal, a metal and steel.

17. The apparatus according to claim 11, wherein the distressing bodies (4) are formed in at least one of a spherical shape, an annular shape, a polygonal shape and a cylindrical shape.

* * * * *